US006376141B1

(12) United States Patent
Mishra et al.

(10) Patent No.: US 6,376,141 B1
(45) Date of Patent: Apr. 23, 2002

(54) PHOTORECEPTOR WITH LAYERED CHARGE GENERATION SECTION

(75) Inventors: Satchidanand Mishra, Webster; Anthony M. Horgan, Pittsford; Kathleen M. Carmichael, Williamson; Steven P Nonkes, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 24 days.

(21) Appl. No.: 09/833,764

(22) Filed: Apr. 13, 2001

(51) Int. Cl.[7] ..... G03G 5/06

(52) U.S. Cl. ..... 430/57.3; 430/58.8; 430/129; 430/78

(58) Field of Search ..... 430/57.3, 58.8, 430/78, 129

(56) References Cited

U.S. PATENT DOCUMENTS

| | | | | |
|---|---|---|---|---|
| 4,233,384 | A | 11/1980 | Turner et al. | 430/59 |
| 4,265,990 | A | 5/1981 | Stolka et al. | 430/59 |
| 4,286,033 | A | 8/1981 | Neyhart et al. | 430/58 |
| 4,291,110 | A | 9/1981 | Lee | 430/59 |
| 4,299,897 | A | 11/1981 | Stolka et al. | 430/59 |
| 4,306,008 | A | 12/1981 | Pai et al. | 430/59 |
| 4,338,387 | A | 7/1982 | Hewitt | 430/58 |
| 4,439,507 | A | 3/1984 | Pan et al. | 430/59 |
| 4,587,189 | A | 5/1986 | Hor et al. | 430/59 |
| 4,654,284 | A | 3/1987 | Yu et al. | 430/59 |
| 4,882,254 | A | 11/1989 | Loutfy et al. | 430/59 |
| 5,019,473 | A | 5/1991 | Nguyen et al. | 430/58 |
| 5,322,755 | A | 6/1994 | Allen et al. | 430/96 |
| 5,418,107 | A | 5/1995 | Nealey et al. | 430/132 |
| 5,420,268 | A | 5/1995 | Desilets et al. | 540/141 |
| 5,473,064 | A | 12/1995 | Mayo et al. | 540/141 |
| 5,521,306 | A | 5/1996 | Burt et al. | 540/141 |
| 5,552,253 | A | 9/1996 | Kovacs et al. | 430/57 |
| 5,571,647 | A | 11/1996 | Mishra et al. | 430/58 |
| 5,686,215 | A | 11/1997 | Bergfjord, Sr. et al. | 430/69 |
| 5,725,985 | A | 3/1998 | Nealey et al. | 430/59 |
| 5,863,686 | A | 1/1999 | Yuh et al. | 430/59 |
| 5,874,192 | A * | 2/1999 | Fuller et al. | 430/96 |
| 6,071,662 | A | 6/2000 | Carmichael et al. | 540/141 |

* cited by examiner

*Primary Examiner*—John Goodrow
(74) *Attorney, Agent, or Firm*—Oliff & Berridge, PLC

(57) ABSTRACT

An electrophotographic imaging member with a charge generation section having separate layers of benzimidazole perylene photoconductive pigment and hydroxygallium ptalocyanine photoconductive pigment.

13 Claims, 3 Drawing Sheets

PHOTORECEPTOR WITH LAYERED CHARGE GENERATION SECTION

BACKGROUND OF THE INVENTION

1. Field of Invention

This invention relates in general to electrophotographic imaging members and more specifically to an improved electrophotographic imaging member having a charge generation section comprised of layers of two different photoconductive pigments. The charge generation section is comprised of a layer of hydroxygallium phthalocyanine photoconductive pigment and a layer of benzimidazole perylene photoconductive pigment.

2. Description of Related Art

In the art of electrophotography, an electrophotographic plate comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable electrophotographic imaging members.

The electrophotographic imaging members may be in the form of plates, drums or flexible belts. These electrophotographic members are usually multilayered photoreceptors that comprise a substrate, a conductive layer, an optional hole blocking layer, an optional adhesive layer, a charge generating layer, a charge transport layer, an optional overcoating layer and, in some belt embodiments, an anticurl backing layer. One type of multilayered photoreceptor comprises a layer of finely divided particles of a photoconductive inorganic compound dispersed in an electrically insulating organic resin binder. In U.S. Pat. No. 4,265,990 a layered photoreceptor is disclosed having separate charge generating (photogenerating) sections and charge transport layers. The charge generation section is capable of photogenerating holes and injecting the photogenerated holes into the charge transport layer.

The charge generating section utilized in multilayered photoreceptors include, for example, inorganic photoconductive particles or organic photoconductive particles dispersed in a film forming polymeric binder. Inorganic or organic photoconductive material may be formed as a continuous, homogeneous charge generation section. Many suitable photogenerating materials known in the art may be utilized, if desired.

Electrophotographic imaging members or photoreceptors having varying and unique properties are needed to satisfy the vast demands of the xerographic industry. The use of organic photogenerating pigments such as perylenes, bisazos, perinones, and polycyclic quinones in electrophotographic applications is well known. Generally, layered imaging members with the aforementioned pigments exhibit acceptable photosensitivity in the visible region of the light spectrum, and hence they are particularly suitable for use in electrophotographic processes where visible light sources such as tungsten, fluorescent, and xenon lamps are used.

However, these classes of pigments in many instances have low or negligible photosensitivity in the near infrared region of the spectrum, for example between about 750 and 970 nanometers, thereby preventing their selection for photoresponsive imaging members in electronic printers wherein electronic light emitting devices, such as GaAs diode lasers, are commonly used as a light source to create an electrostatic image on the imaging members. Also, some of the above mentioned organic pigments have a narrow and restricted spectral response range such that they cannot reproduce certain colors present in the original documents, thus resulting in inferior copy quality.

To satisfy these demands, photoreceptors with different charge generation section formulations providing varying photo-sensitivities may be utilized. Charge generation sections are often formed by layering a dispersion of photoconductive pigments on to the photoreceptor. The cost to develop different photoconductive pigments and different charge generation section coating dispersion formulations and to change dispersion solutions for different products in the manufacturing process greatly increases the costs to manufacture photoreceptors.

The process of making a photoreceptor using dispersions is strongly susceptible to many variables, such as: materials variables, including contents and purity of the material; process variables, including milling time and milling procedure; and coating process variables, including web coating, dip coating, the drying process of several layers, the time interval between the coatings of successive layers etc. The net outcome of all these variables is that the electrical characteristics of photoreceptors may be inconsistent during the manufacturing process.

Sensitivity is a very important electrical characteristic of electrophotographic imaging members or photoreceptors. Sensitivity may be described in two aspects. The first aspect of sensitivity is spectral sensitivity, which refers to sensitivity as a function of wavelength. An increase in spectral sensitivity implies an appearance of sensitivity at a wavelength in which previously no sensitivity was detected. The second aspect of sensitivity, broadband sensitivity, is a change of sensitivity (e.g., an increase) at a particular wavelength previously exhibiting sensitivity, or a general increase of sensitivity encompassing all wavelengths previously exhibiting sensitivity. This second aspect of sensitivity may also be described as change of sensitivity, encompassing all wavelengths, with a broadband (white) light exposure. A common problem encountered in the manufacturing of photoreceptors is maintaining consistent spectral and broadband sensitivity from batch to batch.

A conventional technique for coating cylindrical or drum shaped photoreceptor substrates to form charge generation sections involves dipping the substrates in coating baths. The bath used for preparing charge generation sections is prepared by dispersing photoconductive pigment particles in a solvent solution containing a film forming binder. Unfortunately, some photoconductive pigments cannot be applied by dip coating and still obtain high quality photoconductive coatings due to settling, shear thinning, etc. in the solvent solution and other problems associated with dip coating.

Some pigments tend to settle in the solvent solution of the film forming binder. This may cause a lower than expected amount of photoconductive pigment to be dispersed onto the charge generation section and thus affect the sensitivity of the coated web or other substrate to be coated. Attempting to offset the tendency to settle requires constant stirring which may lead to the entrapment of air bubbles. Such air bubbles may be carried over into the final charge generation section deposited on a photoreceptor substrate resulting in defects in print quality and/or non-uniform charge generation sections. The settling of the pigments may also result in pigment agglomerates which likewise may lead to defects in print quality and/or non-uniform charge generation sections. The settling of the pigments may also cause streak surface coating defects in the charge generation section through the depositing of pigments in a concentration level other than a desired concentration level in localized portions of the charge generation section.

Shear thinning is another common problem in the development of charge generation sections. Shear thinning occurs when forces of varying magnitudes are applied to a non-Newtonian solution resulting in disparate changes in the nature of the non-Newtonian solution. Newtonian solutions are preferred for dip coating since uniform results in the charge generation section are more likely to occur.

Typically, flexible photoreceptor belts are fabricated by depositing the various layers of photoactive coatings onto long webs which are thereafter cut into sheets. The opposite ends of each photoreceptor sheet are overlapped and ultrasonically welded together to form an imaging belt. In order to increase throughput during the web coating operation, the webs to be coated have a width of twice the width of a final belt. After coating, the web is slit lengthwise and thereafter transversely cut into predetermined lengths to form photoreceptor sheets of precise dimensions that are eventually welded into belts. The web length in a coating run may be many thousands of feet long and the coating run may take more than an hour for each layer.

The coating solution may be kept in a pressure pot prior to and during application. The manufacturing of multilayered photoreceptors containing perylene pigment dispersion in the charge-generating layer may require several hours. In general, photoconductive pigment loadings of 80 percent by volume in a binder resin or a mixed resins binder are highly desirable in the charge generation section to provide excellent photosensitivity. However, these dispersions are highly unstable to extrusion coating conditions, resulting in numerous coating defects that generate a large amount of unacceptable material that must be thrown away when using extrusion coating with a dispersion of pigment in an organic solution of polymeric binder. More stable dispersions can be obtained by reducing the pigment loading to 30–40 percent by volume, but in most cases the resulting "diluted" photogenerating layer does not provide adequate photosensitivity. Also, the dispersions of higher pigment loadings generally provide a photoreceptor layer with poor to adequate adhesion to either the underlying ground plane or adhesive layer, or the overlying transport layer when polyvinylbutyral binders are utilized in the charge generation section. Many of these organic dispersions are quite unstable with respect to pigment agglomeration, resulting in dispersion settling and the formation of dark streaks and spots of pigment during the coating process.

A need to increase the sensitivity of a photoreceptor may also exist without the aforementioned potential causes of change in sensitivity. A photoreceptor with only BZP may not provide sufficient sensitivity and a photoreceptor with a higher sensitivity may be desired.

Previous attempts to overcome the aforementioned problems associated with dip coating have led to the development of a charge generation section containing a mixture of two different pigment dispersions comprising:

(1) titanyl phthalocyanine (TiOPC) and (2) chloro indium phthalocyanine (ClInPC).

See, for example, U.S. Pat. No. 5,418,107. Both pigments are dispersed within polyvinyl butyral binder in n-butyl acetate (nBuOAc) solvent. These two dispersions have different sensitivities. By mixing different ratios of these two dispersions, different levels of photosensitivity may be achieved enabling the manufacture of different photoreceptors with varying charge generation layers. However, this mixture of TiOPC and ClInPC has proven unstable and results in streaking in the prints.

The present inventors have found that the stability problem results mostly from the ClInPC dispersion. The ClInPC exhibits strong shear thinning behavior at higher solids (e.g., 6% by weight). Although the ClInPC dispersion becomes Newtonian after being diluted down to about 3%, it still settles upon sitting for a few days. The settling of the ClInPC dispersion is likely caused by the low viscosity of the solution and agglomeration of the ClInPC dispersion.

The above-mentioned U.S. Pat. No. 5,418,107 thus describes a photoconductive layer comprised of a mixture of at least two different phthalocyanine pigments free of vanadyl phthalocyanine pigment particles. The selected pigment particles have an average particle size of less than about 0.6 micrometers and preferably less than about 0.4 micrometers. Typical mixtures of photoconductive particles include metal-free phthalocyanine and titanyl phthalocyanine, chloro indium phthalocyanine and titanyl phthalocyanine, and hydroxygallium phthalocyanine and titanyl phthalocyanine. Satisfactory results are achieved when the selected pigment particles comprise about 50–90% by weight of the dried photoconductive layer, with each of the individual pigments comprising at least about 5% of the total weight of the pigment. The pigments are dispersed in a solution of a film forming polyvinyl butyral dissolved in an alkyl acetate solvent. The use of perylene pigments is not taught by the examples and embodiments of this reference. The reference in fact teaches that the use of benzimidazole perylene pigments leads to settling, thus causing poor results in xerographic printing (column 1, lines 43–50).

U.S. Pat. No. 4,882,254 describes a photoconductive layer comprised of a mixture of photoconductive pigments providing a varied spectral response depending on the mixture of photoconductive pigments selected. The photoconductive pigments include metal phthalocyanines, or metal free phthalocyanines with quinacridones, perylenes, anthanthrones, perinones, pyranthrones, indogoides and bisazos. A preferred embodiment uses a pigment mixture of BZP and vanadyl phthalocyanine. The conductive pigments selected are utilized in a ratio of 10–90% of the first pigment and 90–10% of the second pigment.

U.S. Pat. No. 5,725,985 describes an electrophotographic imaging member having a charge generation layer comprised of photoconductive particles of hydroxygallium phthalocyanine and titanyl phthalocyanine dispersed in a polymer matrix of a film forming terpolymer reaction product and a film forming copolymer reaction product. The film forming terpolymer reaction product results from vinyl chloride, vinyl acetate and maleic acid. The film forming copolymer reaction product results from vinyl chloride and vinyl acetate. The photoconductive particles are present in an amount of about 50% to about 65% by weight of the charge generation layer with an optimal amount identified as 60% by weight. The relative amounts of hydroxygallium phthalocyanine and titanyl phthalocyanine are not disclosed.

U.S. Pat. No. 5,571,647 describes an electrophotographic imaging member comprised of a support substrate having a two layered electrically conductive outer surface, a charge generation layer comprised of photoconductive particles of perylene or phthalocyanine dispersed in a film forming resin binder blend of polyvinyl butyral polymer and one or two copolyesters. The perylenes may comprise between about 20% and about 90% of the total volume of the dried charge generating layer. Optimum results are obtained when the perylenes comprise about 35% to about 45% by volume. It is not disclosed that the photoconductive particles may be mixed.

U.S. Pat. No. 5,863,686 describes an electrophotographic imaging member comprised of a supporting substrate, an undercoat layer doped with a donor molecule, a charge transport layer and a charge generation layer. The donor molecule donates an electron to a photoconductive pigment when it is exposed to light. Benzimidazole perylene and dibromoanthrone are described as being known photoconductive particles for use in the charge generation layer. It is further described that benzimidazole perylene dispersed in a polyvinyl butyral film forming binder in combination with the donor molecule dissolved in the polyvinyl butyral film forming binder leads to dramatic improvements in sensitivity. It is not disclosed that the photoconductive particles may be mixed.

U.S. Pat. No. 5,521,306 describes a process for preparation of a Type V hydroxygallium phthalocyanine comprising the in situ formation of an alkoxy-bridged gallium phthalocyanine dimer, hydrolyzing the dimer to hydroxygallium phthalocyanine and subsequently converting the hydroxygallium phthalocyanine product obtained to a Type V hydroxygallium phthalocyanine.

U.S. Pat. No. 5,552,253 describes a photoreceptor comprising at least two photoconductive stacks. Each photoconductive stack contains a charge generator layer and charge transport layer. The photoconductive stacks are sensitive to different wavelengths to allow selective discharge for a particular wavelength of light. The reference does not teach the use of benzimidazole perylene and hydroxygallium pthalocyanine together in the same charge generator layer, nor the use of these pigments in adjacent generator layers (since a charge transport layer would separate the layers), and thus does not teach the enhancement of sensitivity obtained by mixing the photoconductive pigments.

U.S. Pat. No. 5,322,755 describes a layered photoconductive imaging member comprising a supporting substrate, a photogenerator layer comprising perylene photoconductive pigments dispersed in a resin binder mixture comprising at least two polymers, and a charge transport layer. The resin binder can be, for example, a mixture of polyvinylcarbazole and polycarbonate homopolymer or a mixture of polyvinylcarbazole, polyvinylbutyral and polycarbonate homopolymer or a mixture of polyvinylcarbazole and polyvinylbutyral or a mixture of polyvinylcarbazole and a polyester. Although improvement in photosensitivity and adhesion are achieved, charge deficient spots print defects can still be a problem. Thus, there is a continuing need for improved photoreceptors that exhibit freedom from charge deficient spots and are more resistant to layer delamination during slitting, grinding, buffing, polishing, and dynamic belt image cycling.

U.S. Pat. No. 5,473,064, describes a process for the preparation of Type V hydroxygallium phthalocyanine, essentially free of chlorine, whereby a chlorogallium phthalocyanine pigment precursor is prepared by reaction of gallium chloride with 1,3-diiminoisoindoline in a solvent such as N-methylpyrrolidone; hydrolyzing said pigment precursor chlorogallium phthalocyanine by, for example, dissolving the pigment precursor in concentrated sulfuric acid, and then reprecipitating in a solvent, such as water, or a dilute ammonia solution; and subsequently treating the resulting hydroxygallium phthalocyanine with a solvent, such as N,N-dimethylformamide, by for example, ball milling said hydroxygallium phthalocyanine pigment in the presence of spherical glass beads. The Type V hydroxygallium phthalocyanine obtained from the chlorogallium phthalocyanine precursor prepared according to this procedure contains very low levels of residual chlorine of from about 0.001 percent to about 0.1 percent of the weight of the Type V hydroxygallium pigment as determined by elemental analysis and can enable improved electrical performance of the Type V hydroxygallium as a photogenerating pigment, and improved desirable dark decay and cycling characteristics for the resulting photoconductive imaging member.

What is still desired is an electrophotographic imaging member that avoids problems of the prior art discussed above and that is comprised of at least two layers of photoconductive pigments exhibiting stable properties when applied to a photoreceptor using a solvent solution of a film forming binder.

SUMMARY OF THE INVENTION

It is an object of the present invention to provide an improved photoreceptor having high quality photoconductive coatings which overcomes the above-noted deficiencies. It is another object of the invention to provide for stable pigment dispersions for use in photoreceptors. It is yet another object of the invention to maximize sensitivity in a fixed narrow wavelength band and in the near infra-red wavelength region. It is yet another object of the invention to maximize sensitivity over a broadband of exposure.

These and other objects of the present invention are achieved by providing an electrophotographic imaging member comprising a charge generation section including separate layers of photogenerating particles of:

(1) benzimidazole perylene (BZP), and (2) hydroxygallium phthalocyanine (HoGaPC).

BRIEF DESCRIPTION OF THE DRAWINGS

FIG. 1 shows the wavelength dependence of sensitivity of a sample with a pigment ratio of 100% HoGaPC in the charge generation section in comparison with that of a sample charge generation section containing 100% BZP.

FIG. 2 shows the wavelength dependence of sensitivity of a sample with a layer of BZP under a layer of HoGaPC at an optical density of 3.0 in the charge generation section in comparison with that of a sample charge generation section containing 100% BZP.

FIG. 3 shows the wavelength dependence of sensitivity of a sample with a layer of BZP under a layer of HoGaPC at an optical density of 1.5 in the charge generation section in comparison with that of a sample charge generation section containing 100% BZP.

FIG. 4 shows the wavelength dependence of sensitivity of a sample with a layer of HoGaPC under a layer of BZP at an optical density of 3 in the charge generation section in comparison with that of a sample charge generation section containing 100% BZP.

FIG. 5 shows the wavelength dependence of sensitivity of a sample with a layer of HoGaPC under a layer of BZP at an optical density of 1.5 in the charge generation section in comparison with that of a sample charge generation section containing 100% BZP.

DETAILED DESCRIPTION OF PREFERRED EMBODIMENTS

Figure 1:
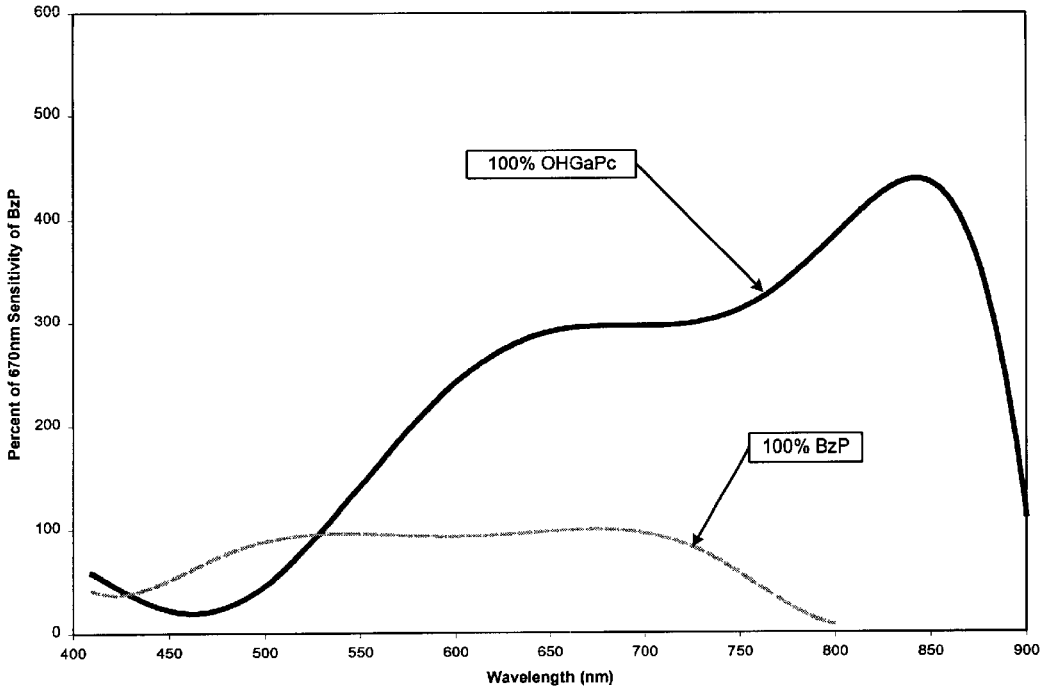
FIGS. 1 through 5 show the experimental results of electrophotographic imaging members having different layers of photoconductive particles in the charge generation section of an imaging member. In particular, the figures show the effect on sensitivity of such layers in comparison to a photoreceptor containing 100% BZP pigments in the generation section. The figures also show the % increase in sensitivity as a function of wavelength in comparison to the sensitivity of a BZP sample at 670 nanometers.

Electrophotographic imaging members, i.e., photoreceptors, in the form of plates, drums or flexible belts are well known in the art. Typically, a substrate is provided having an electrically conductive surface. At least one charge generation section (layer) or photoconductive layer is then applied to the electrically conductive surface. A charge-blocking layer may be applied to the electrically conductive surface prior to the application of the charge-generating layer (photoconductive layer). If desired, an adhesive layer may be utilized between the charge blocking layer and the photoconductive layer. For multilayered photoreceptors, a charge generation layer or charge generation section is usually applied onto the blocking layer or optional adhesive layer and a charge transport layer (hole transport layer) is formed on the charge generation section. However, if desired, the charge generation section or layer may be applied to the charge transport layer. Optionally, an overcoating layer may be applied to increase abrasion resistance. Optionally, an anti-curl backing layer may be applied to improve abrasion resistance and/or shape.

The charge generation section of the present invention comprises a layer of hydroxygallium phthalocyanine and a layer of benzimidazole perylene as photoconductive pigments and may further contain therein aryl amine hole transport molecules. The charge generation section may be incorporated into a photoresponsive imaging member that is negatively charged when the charge generation section is situated between the charge transport layer and the substrates, or positively charged when the hole transport layer is situated between the charge generation section and the supporting substrate. Additionally, the photoresponsive imaging member may contain an aryl amine charge transport layer, which is especially useful for xerographic processes wherein negatively charged or positively charged images are rendered visible with developer compositions of the appropriate charge. The electrophotographic imaging member of the present invention may be utilized with gas and diode lasers, light emitting diodes (LED), broad-band light sources such as tungsten, fluorescent, and xenon lamps. The electrophotographic imaging member of the present invention may be utilized in a printer, copier, fax machine, etc. The broad spectrum response of the imaging members of this invention enable their selection for multifunction electrophotography processes employing the aforementioned light sources.

The photo-conductor substrate may comprise any suitable organic or inorganic material known in the art. The substrate may be formulated entirely of an electrically conductive material, or it may be an insulating material having an electrically conductive surface.

The substrate may be opaque or substantially transparent and may comprise numerous suitable materials having the required mechanical properties. Accordingly, the substrate may comprise a layer of an electrically non-conductive or conductive material as an inorganic or an organic composition. The entire substrate may comprise the same material as that in the electrically conductive surface or the electrically conductive surface can be merely a coating on the substrate.

Any suitable electrically conductive material can be employed. Typical electrically conductive materials include copper, brass, nickel, zinc, chromium, stainless steel, conductive plastics and rubbers, aluminum, semitransparent aluminum, steel, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. As electrically non-conducting materials that may be employed are various resins known for this purpose including polyesters, polycarbonates, polyamides, polyurethanes, paper, glass, plastic, polyesters such as Mylar (available from Du Pont) or Melinex 447 (available from ICI Americas, Inc.), and the like which are rigid or flexible, such as webs.

The thickness of the substrate layer depends on numerous factors, including mechanical and economical considerations, and thus this layer for a flexible belt may be of substantial thickness, for example, about 125 micrometers, or of minimum thickness less than 50 micrometers, provided there are no adverse effects on the final electrostatographic device. The substrate can be either rigid or flexible. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, e.g., 19 millimeter diameter rollers. Substrates in the shape of a drum or cylinder may comprise a metal, plastic or combinations of metal and plastic of any suitable thickness depending upon the degree of rigidity desired.

The conductive layer may vary in thickness over substantially wide ranges depending upon the optical transparency and degree of flexibility desired for the electrostatographic member. Accordingly, for a flexible photoresponsive imaging device, the thickness of the conductive layer may be between about 20 Angstroms to about 750 Angstroms, and more preferably from about 100 Angstroms to about 200 Angstroms for a preferred combination of electrical conductivity, flexibility and light transmission. The flexible conductive layer may be an electrically conductive metal layer formed, for example, on the substrate by any suitable coating technique, such as a vacuum depositing technique. Where the substrate is metallic, such as a metal drum, the outer surface thereof is normally inherently electrically conductive and a separate electrically conductive layer need not be applied.

After formation of an electrically conductive surface, a hole blocking layer may optionally be applied thereto. Generally, hole blocking layers (also referred to as electron blocking layers or charge blocking layers) for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. Blocking layers are well known and disclosed, for example, in U.S. Pat. Nos. 4,286,033, 4,291,110 and 4,338,387, the entire disclosures of each being incorporated herein by reference. Typical hole blocking layers utilized for the negatively charged photoconductors may include, for example, polyamides such as Luckamide (a nylon type material derived from methoxymethyl-substituted polyamide), hydroxy alkyl methacrylates, nylons, gelatin, hydroxyl alkyl cellulose, organopolyphosphazines, organosilanes, organotitanates, organozirconates, silicon oxides, zirconium oxides, and the like. Preferably, the hole blocking layer comprises nitrogen containing siloxanes. Typical nitrogen containing siloxanes are prepared from coating solutions containing a hydrolyzed silane. Typical hydrolyzable silanes include 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

The hole blocking layer may be applied as a coating by any suitable conventional technique such as spraying, die coating, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. Drying of the deposited coating may be effected by any suitable conventional technique such as oven drying, infrared radiation drying, air drying and the like.

The blocking layer may comprise an oxidized surface which inherently forms on the outer surface of most metal ground plane surfaces when exposed to air. The blocking layer should be continuous and have a thickness of less than about 2 micrometers because greater thicknesses may lead to undesirably high residual voltage.

An optional adhesive layer may be applied to the hole blocking layer. Any suitable adhesive layer well known in the art may be utilized. Satisfactory results may be achieved with an adhesive layer thickness between about 0.05 micrometer (500 Angstroms) and about 0.3 micrometer (3,000 Angstroms). Conventional techniques for applying an adhesive layer coating mixture to the charge blocking layer include spraying, dip coating, roll coating, wire wound rod coating, gravure coating, Bird applicator coating, die coating and the like. Drying of the deposited coating may be effected by any suitable conventional technique such as oven drying, infra red radiation drying, air drying and the like.

The photogenerating pigments are dispersed in a polymer or copolymer binder to form the charge generation section. The polymer binder may comprise any known polymer or copolymer binder known in the art.

The charge generation section of this invention may be prepared by the application of separate coating dispersions made from BZP or HoGaPC photoconductive pigment particles. The coating dispersion may be in the form of a dispersion of the pigment particles in a solvent solution containing a film forming binder.

Photosensitivity describes a pigment's response to light. A photosensitive pigment generates charges in the presence of light. BZP is most responsive to the light spectrum at a range of for example, about 450 nanometers to about 750 nanometers, but exhibits decreasing responsiveness beyond 700 nanometers and is generally unresponsive to the light spectrum above about 780 nanometers. The preferred wavelengths for photogeneration are between 500 nanometers and 700 nanometers and may include a broadband between the two wavelengths.

HoGaPC is most responsive at a range of for example, about 550 nanometers to about 880 nanometers and is generally unresponsive to the light spectrum below about 500 nanometers. The preferred wavelengths for photogeneration are between 600 nanometers and 850 nanometers and may include a broadband between the two wavelengths. Single wavelength exposure is preferred between 750 nanometer and 850 nanometers.

The charge generation section of the present invention employs a combination of layers of HoGaPC and BZP photoconductive pigments to provide photosensitivity at a broader range of the light spectrum, for example, about 450 to about 880 nanometers.

The BZP and HoGaPC pigment particles used in charge generation section have a size of, for example, less than about 1.0 micrometers. Preferably, the particles used herein have a size of, for example, about 0.005 to about 0.6 micrometers. Most preferably, the particles used herein have a size of, for example, about 0.01 to about 0.1 micrometers.

BZP (benzimidazole perylene) is also referred to as bis (benzimidazole). This pigment exists in the cis and trans forms. The cis form is also called bisbenzimidazo(2,1-a-1', 1'-b)anthra(2,1,9-def:6,5,10-d'e'f')disoquinoline-6,11-dione. The trans form is also called bisbenzimidazo(2,1-a1', 1'-b) anthra(2,1,9-def:6,5,10-d'e'f')disoquinoline-10,21-dione. Benzimidazole perylene is described in U.S. Pat. No. 5,019, 473 and U.S. Pat. No. 4,587,189, the entire disclosures thereof being incorporated herein by reference.

HoGaPC (hydroxygallium phthalocyanine) is thoroughly described in U.S. Pat. Nos. 5,521,306 and 5,473,064, which are herein incorporated by reference. Both patents describe processes to prepare Type V hydroxygallium phthalocyanine. The processes and Type V hydroxygallium phthalocyanine are suitable for use in the present invention.

The present invention provides for both an increase in spectral and broadband sensitivity. The use of separate layers of HoGaPC and BZP in the charge generation section of a photoreceptor may result in an increase of sensitivity of 4 to 6 times and result in a photoreceptor or electrophotographic imaging member that is sensitive to wavelength of light between 450 and 880 nanometers.

Typically, photoreceptors containing only BZP pigment have a sensitivity of about 90 to 100 volts·cm$^2$/Erg. In some instances, the addition of a layer of HoGaPC to a BZP photoreceptor may even result in an increase of higher than 5 to 6 times in sensitivity. Notably, the broadband sensitivity in the near infrared region, i.e., that wavelengths between about 750 nanometers to about 970 nanometers, is especially affected by the addition of a layer of HoGaPC to a BZP charge generation section.

The broadband sensitivity in the region of between about 650 and about 850 nanometers is also significantly increased, especially when compared to a charge generation section of 100% HoGaPC. Also, a charge generation section having separate layers of HoGaPC and BZP may even exhibit higher sensitivity than a charge generation section having only a layer of HoGaPC or BZP.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 40 percent by volume to about 60 percent by volume of the photogenerating pigment is dispersed in about 40 percent by volume to about 60 percent by volume of the resinous binder composition. In one embodiment, about 8 percent by volume of the photogenerating pigment is dispersed in about 92 percent by volume of the resinous binder composition.

Examples of suitable binders for the photoconductive materials include thermoplastic and thermosetting resins such as polycarbonates, polyesters, including polyethylene terephthalate, polyurethanes, polystyrenes, polybutadienes, polysulfones, polyarylethers, polyarylsulfones, polyethersulfones, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinones, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

Any suitable solvent may be utilized to dissolve the film forming binder. Typical solvents include, for example, cyclohexanone, tetrahydrofuran, toluene, methylene chloride, monochlorobenzene and the like.

Coating dispersions for the charge generation section may be formed by any suitable technique using, for example, attritors, ball mills, Dynomills, paint shakers, homogenizers, microfluidizers, and the like.

Any suitable and conventional technique may be utilized to mix and thereafter apply the charge generation section coating mixture. Typical application techniques include spraying, dip coating, roll coating, wire wound rod coating, and the like. Drying of the deposited coating may be effected by any suitable conventional technique such as oven drying, infra red radiation drying, air drying and the like. Drying is determined to be sufficient when the deposited film is no longer wet (not tacky to the touch). In an preferred embodiment, dip coating is used to apply the charge generation section to the photoreceptor.

The charge generation section containing photoconductive compositions and the resinous binder material generally ranges in thickness from about 0.05 micron to about 10 microns or more, preferably being from about 0.1 micron to about 5 microns, and more preferably having a thickness of from about 0.3 micron to about 3 microns, although the thickness can be outside these ranges. The charge generation section thickness is related to the relative amounts of photogenerating compound and binder, with the photogenerating material often being present in amounts of from about 5 to about 100 percent by weight. Higher binder content compositions generally require thicker layers for photogeneration. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, the specific photogenerating compound selected, the thicknesses of the other layers, and whether a flexible photoconductive imaging member is desired.

The charge generation section of the present invention is preferably formed by a layer of hydroxygallium phthalocyanine and a layer of benzimidazole perylene. The layer of either the hydroxygallium phthalocyanine or benzimidazole perylene may be formed by repeated applications of a dispersion containing the hydroxygallium phthalocyanine or benzimidazole perylene photoconductive pigments. Preferably, the layer of hydroxygallium phthalocyanine and benzimidazole perylene are immediately adjacent to each other. In an especially preferred embodiment, a negatively charged electrophotographic imaging member is formed wherein the charge generation section is in between the substrate and charge transport layer. In this especially preferred embodiment, it is essential that the charge transport layer is adjacent to the layer hydroxygallium phthalocyanine of the charge generation section.

The active charge transport layer may comprise any suitable activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the direction of photogenerated holes from the generation material and capable of allowing the transport of these holes through the active layer in order to discharge the surface charge on the active layer.

An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming binder resin in which the aromatic amine is soluble.

The charge transport layer forming mixture preferably comprises an aromatic amine compound of one or more compounds having the general formula:

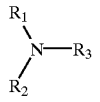

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups and the like.

Examples of charge transporting aromatic amines represented by the structural formulae above for charge transport layers capable of supporting the injection of photogenerated holes of a charge generation section and transporting the holes through the large transport layer include, for example, triphenylmethane, bis(4-diethylamine-2-methylphenyl) phenylmethane, 4'-4"-bis(diethylamino)-2',2"-dimethyltriphenylmethane, N,N'-bis(alkylphenyl)-{1,1'-biphenyl}-4,4'-diamine wherein the alkyl is, for example, methyl, ethyl, propyl, n-butyl, etc., N,N'-diphenyl-N,N'-bis (chlorophenyl)-{1,1'-biphenyl}-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride or other suitable solvent such as, for example, tetrahydrofuran, toluene, monochlorobenzene and the like may be employed in the process of this invention. Typical inactive resin binders soluble in methylene chloride include polycarbonate resin, polyvinylcarbazole, polyester, polyarylate, polyacrylate, polyether, polysulfone, and the like. Weight average molecular weights can vary from about 20,000 to about 150,000.

Any suitable and conventional technique may be utilized to mix and thereafter apply the charge transport layer coating mixture to the coated or uncoated substrate. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 to about 50 micrometers, but thicknesses outside this range can also be used. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generation section is preferably maintained from about 2:1 to 200:1 and in some instances as great as 400:1.

The preferred electrically inactive resin materials are polycarbonate resins having a weight average molecular weight from about 20,000 to about 150,000, more preferably from about 50,000 about 120,000. The materials most preferred as the electrically inactive resin material is poly(4,4'-dipropylidene-diphenylene carbonate) with a weight average molecular weight of from about 35,000 to about 40,000, available as Lexan 145 from General Electric Company; poly(4,4'-propylidene-diphenylene carbonate) with a weight average molecular weight of from about 40,000 to about 45,000, available as Lexan 141 from the General Electric Company; a polycarbonate resin having a weight average molecular weight of from about 50,000 to about 100,000, available as Makrolon from Farbenfabricken Bayer A. G.; and a polycarbonate resin having a weight average molecular weight of from about 20,000 to about 50,000 available as Merlon from Mobay Chemical Company. Methylene chloride solvent is a desirable component of the charge transport layer coating mixture for adequate dissolving of all the components and for its low boiling point.

Examples of photosensitive members having at least two electrically operative layers include the charge generator layer and diamine containing transport layer members disclosed in U.S. Pat. Nos. 4,265,990, 4,233,384, 4,306,008, 4,299,897 and 4,439,507. The disclosures of these patents are incorporated herein in their entirety. The photoreceptors may comprise, for example, a charge generator layer sandwiched between conductive surface and a charge transport layer as described above or a charge transport layer sandwiched between a conductive surface and a charge generator layer. Optionally, an overcoat layer may also be utilized to improve resistance to abrasion. In some cases, an anti-curl back coating may be applied to the side opposite the photoreceptor to provide flatness and/or abrasion resistance where a web configuration photoreceptor is fabricated. These overcoating and anti-curl back coating layers are well known in the art and may comprise thermoplastic organic polymers or inorganic polymers that are electrically insulating or slightly semi-conductive. Overcoatings are continuous and commercially have a thickness of less than about 10 micrometers. The thickness of anti-curl backing layers should be sufficient to substantially balance the total forces of the layer or layers on the opposite side of the supporting substrate layer. An example of an anti-curl backing layer is described in U.S. Pat. No. 4,654,284, the entire disclosure of which being incorporated herein by reference. A thickness between about 70 and about 160 micrometers is a satisfactory range for flexible photoreceptors.

EXAMPLE I

A BZP charge generation section dispersion is prepared by introducing 0.45 grams of Iupilon200 (PCZ-200) available from Mitsubishi Gas Chemical Corp. and 50 ml of tetrahydrofuran into a 4 oz. glass bottle. To this solution is added 2.4 grams of BZP and 300 grams of ⅛ inch (3.2 millimeter) diameter stainless steel shot. This mixture is then placed on a ball mill for 72 to 96 hours. Subsequently, 2.25 grams of PCZ-200 is dissolved in 46.1 grams of tetrahydrofuran and then added to the BZP slurry. This slurry is then placed on a shaker for 10 minutes.

A HoGaPC charge generation section dispersion is prepared by introducing 0.45 grams of Iupilon200 (PCZ-200) available from Mitsubishi Gas Chemical Corp. and 50 ml of tetrahydrofuran into a 4 oz. glass bottle. To this solution is added 2.4 grams of HoGaPC and 300 grams of ⅛ inch (3.2 millimeter) diameter stainless steel shot. This mixture is then placed on a ball mill for 20 to 24 hours. Subsequently, 2.25 grams of PCZ-200 is dissolved in 46.1 gm of tetrahydrofuran, then added to this HoGaPC slurry. This slurry is then placed on a shaker for 10 minutes.

An electrophotographic imaging member is prepared by providing a 0.02 micrometer thick titanium layer coated on a polyester substrate (Melinex 442, available from ICI Americas, Inc.) having a thickness of 3 mils (76.2 micrometers) and applying thereto, using a ½ mil gap Bird applicator, a solution containing 10 grams gamma aminopropyltriethoxysilane, 10.1 grams distilled water, 3 grams acetic acid, 684.8 grams of 200 proof denatured alcohol and 200 grams heptane. This layer is then allowed to dry for 5 minutes at 135° C. in a forced air oven. The resulting blocking layer has an average dry thickness of 0.05 micrometer measured with an ellipsometer.

An adhesive interface layer is then prepared by applying with a ½ mil gap Bird applicator to the blocking layer a wet coating containing 0.5 percent by weight based on the total weight of the solution of polyester adhesive (Mor-Ester 49,000, available from Morton International, Inc.) in a 70:30 volume ratio mixture of tetrahydrofuran/cyclohexanone. The adhesive interface layer is allowed to dry for 5 minutes at 135° C. in a forced air oven. The resulting adhesive interface layer has a dry thickness of 0.065 micrometer.

The adhesive interface layer is thereafter coated with the dispersion containing 100 percent of pigment by volume BZP using a ½ mil gap Bird applicator to form a coating layer having a wet thickness of 0.5 mil (12.7 micrometers). This charge generation section is dried at 135° C. for 5 minutes in a forced air oven to form a dry charge generation section having a thickness of 1.0 micrometers and an optical density of 2.0.

Next, a layer of HoGaPC is coated upon the BZP layer using the solution prepared in Example I with a coating bar having a ¼ mil gap. The sample is dried at 135° C. for five minutes after each coating layer in a forced air oven to form a dried charge generation section. The total optical density of the sample is measured to be 3.0. However, a strip about 10 mm wide along one edge of the substrate bearing the blocking layer and the adhesive layer is deliberately left uncoated by either of the charge generation section dispersions to facilitate adequate electrical contact by the ground strip layer that is applied later.

This coated imaging member web is simultaneously overcoated with a charge transport layer and a ground strip layer using a 3 mil gap Bird applicator. The charge transport layer is prepared by introducing into an amber glass bottle a weight ratio of 1:1 N,N'-diphenyl-N,N'-bis(3-methylphenyl)-1,1'-biphenyl-4-4'-diamine and Makrolon 5705, a polycarbonate resin having a molecular weight of from about 50,000 to 100,000 commercially available from Farbenfabriken Bayer A.G. The resulting mixture is dissolved to give a 15 percent by weight solid in 85 percent by weight methylene chloride. This solution is applied onto the charge generation section to form a coating which upon drying has a thickness of 24 micrometers.

The approximately 10 mm wide strip of the adhesive layer left uncoated by the charge generation section is coated with a ground strip layer. This ground strip layer, after drying at 135° C. in a forced air oven for 5 minutes, has a dried thickness of about 14 micrometers. This ground strip is electrically grounded, by conventional means such as a carbon brush contact device during a conventional xerographic imaging process.

An anti-curl coating is prepared by combining 8.28 grams by weight of polycarbonate resin of 4,4'-isopropylidene diphenol having a weight average molecular weight of about 120,000 and a glass transition temperature (Tg) of 150° C. (Makrolon 5705, available from Bayer AG), 0.72 grams of copolyester resin (Vitel PE-2200, available from Bostik, Inc.) and 91 grams of methylene chloride in a glass container to form a coating solution containing 9 percent solids. The container is covered tightly and placed on a roll mill for about 24 hours until the polycarbonate and polyester are dissolved in the methylene chloride to form the anti-curl coating solution. The anti-curl coating solution is then applied to the rear surface (side opposite the charge generation section and charge transport layer) of the imaging member with a 4 mil gap Bird applicator and dried at 135° C. for about 5 minutes in a forced air oven to produce a dried film thickness of about 13.5 micrometers and containing approximately 8 weight percent Vitel PE-200, adhesion promoter, based on the total weight of the dried anti-curl layer.

Figure 2:
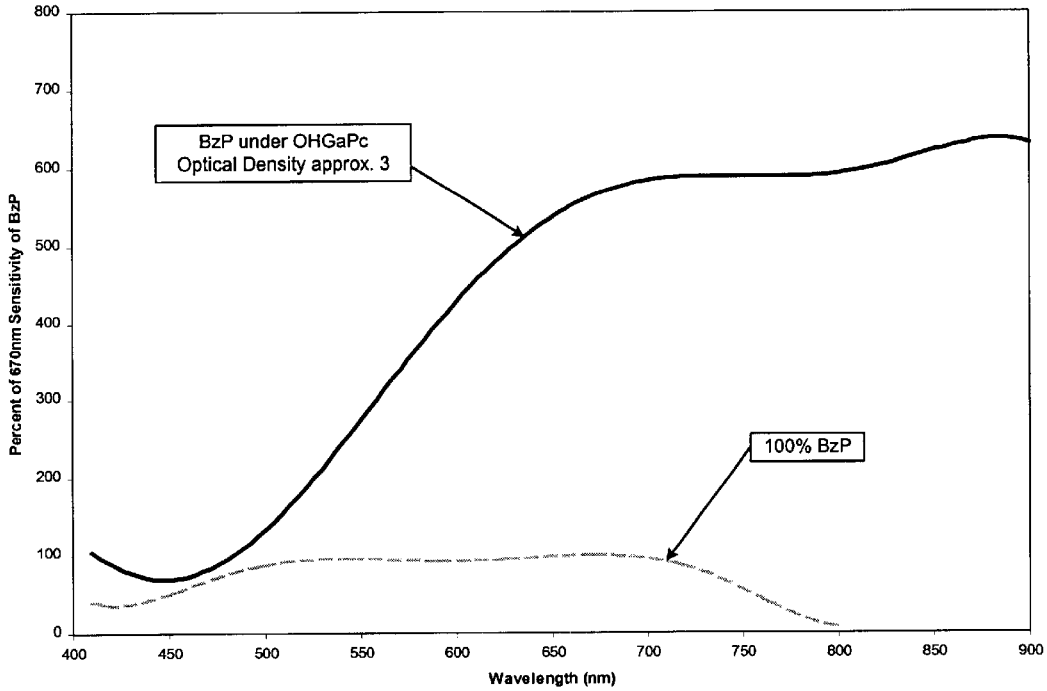

The xerographic properties of the photoconductive imaging sample are evaluated with a xerographic testing scanner comprising a cylindrical aluminum drum having a diameter of 24.26 cm (9.55 inches). The test samples are taped onto the drum. The drum carrying the samples are rotated and produce a constant surface speed of 76.3 cm (30 inches) per second. A direct current pin corotron, exposure light, erase light, and five electrometer probes are mounted around the periphery of the mounted photoreceptor samples. The sample charging time is 33 milliseconds. The sensitivity of an electrophotographic imaging member is measured using the methods described in U.S. Pat. No. 4,882,254, herein incorporated by reference. The member is electrostatically charged in the dark with a corona discharge source operating in the range of −5.0 to −6.0 KV and an initial surface potential $V_o$ of 700 is measured by a capacitively coupled probe attached to an electrometer. The front surface of the charged member is then exposed to light from a filtered Xenon lamp, XBO 75 watt source, allowing monochromatic light in the wavelength range 400 to 900 nanometers to reach the member surface. The exposure intensity is varied in gradual steps from 0 ergs/cm$^2$ to 20 ergs/cm$^2$. The erase light is a broadband white light (400–700 nanometers) output, supplied by a 300 watt output Xenon arc lamp. The erase intensity is kept between 100 to 300 ergs/cm$^2$. After the light exposure, the surface potential is reduced and a final surface potential $V_b$ is measured. A Photoinduced Discharge Curve (PID) is obtained by plotting the potential $V_b$ against the exposure intensity. The slope of the linear portion of this curve gives the sensitivity. The sensitivity at various wavelengths in the range off 400 to 900 nanometers is obtained. The sensitivity is compared with sensitivity at 670 nanometers and the percentage change is plotted in FIG. 2.

EXAMPLE II

Figure 3:
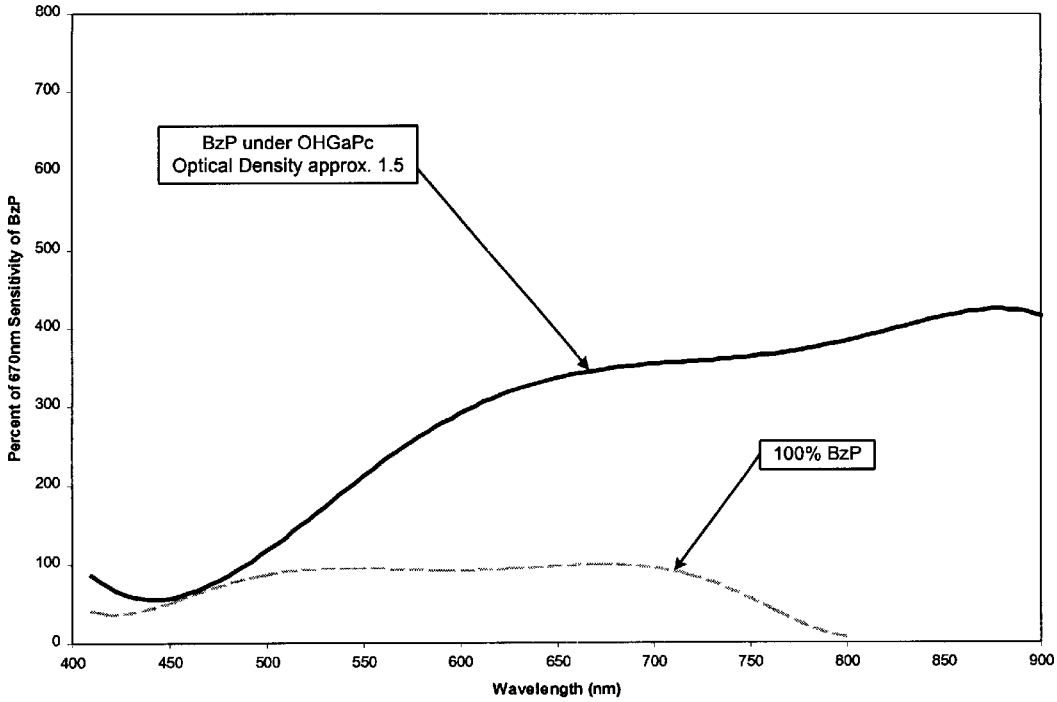

An electrophotographic imaging member is prepared identical to Example I, except the charge generation section dispersions are diluted by adding additional solvent to the charge generation section dispersions. The total optical density is 1.5. The sensitivity was normalized as in Example I and plotted in FIG. 3.

COMPARATIVE EXAMPLE I

An electrophotographic imaging member is prepared identical to Example I, except the charge generation section is prepared solely with the dispersion of Example I that contains 100 percent of pigment by volume of BZP. An optical density of 1.0 is measured. The sensitivity was normalized as in Example I and plotted in FIG. 1.

COMPARATIVE EXAMPLE II

An electrophotographic imaging member is prepared identical to Example I, except the charge generation section is only prepared solely with the dispersion of Example I that contains 100 percent of pigment by volume of HoGaPC. An optical density of 1.0 is measured. The sensitivity was normalized as in Example I and plotted in FIG. 1.

COMPARATIVE EXAMPLE III

Figure 4:
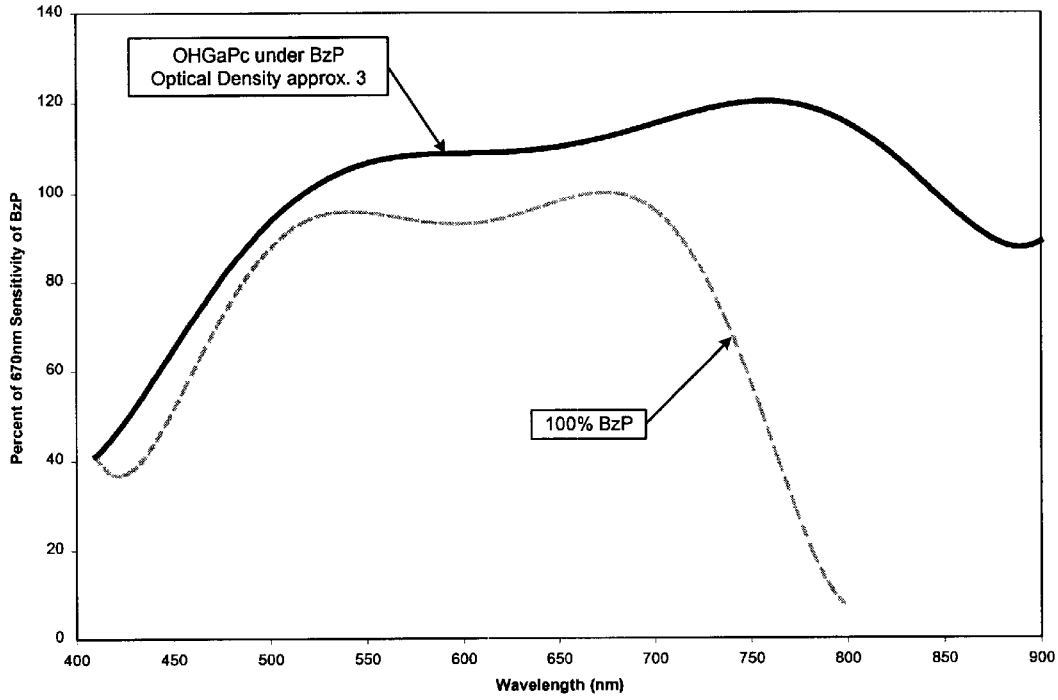

The charge generation section of this comparative example is prepared to identical to Example I, except that the order of the layers in the charge generation section is reversed. First, a charge generation section layer is coated from the dispersion of HoGaPC prepared in Example I. Next, a layer of BZP from the BZP dispersion prepared in Example I is coated on top of HoGaPC layer. The electrophotographic imaging member is completed as in Example I. The total optical density of this Comparative Example is measured to be 3.0. The sensitivity was normalized as in Example I and plotted in FIG. 4.

COMPARATIVE EXAMPLE IV

Figure 5:
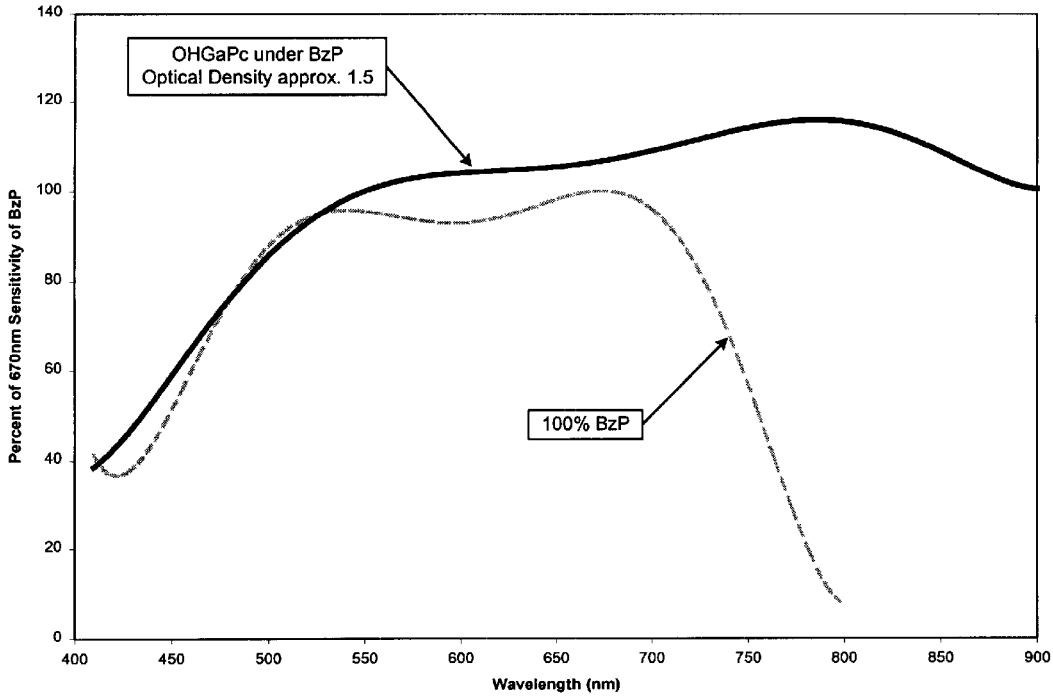

The charge generation section of this Example is prepared identical to Comparative Example III, except that the charge generation section layers were coated from diluted solutions. The total optical density of the sample is 1.5. The sensitivity was normalized as in Example I and plotted in FIG. 5.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An electrophotographic imaging member comprising:

a charge generation section comprising a first layer comprising hydroxygallium phthalocyanine photoconductive pigment in polymer or copolymer binder and a second layer comprising benzimidazole perylene photoconductive pigment in polymer or copolymer binder, wherein the benzimidazole perylene layer and the hydroxygallium phthalocyanine layer are immediately adjacent to each other; and a charge transport layer adjacent to the hydroxygallium phthalocyanine layer of the charge generation section.

2. The electrophotographic imaging member of claim 1, wherein hydroxygallium phthalocyanine is the sole photoconductive pigment in the first layer.

3. The electrophotographic imaging member of claim 1, wherein benzimidazole perylene is the sole photoconductive pigment in the second layer.

4. The electrophotographic imaging member of claim 1, wherein hydroxygallium phthalocyanine is the sole photoconductive pigment in the first layer and benzimidazole perylene is the sole photoconductive pigment in the second layer.

5. The electrophotographic imaging member of claim 1, wherein the electrophotographic imaging member is sensitive to wavelengths of light between 450 and 880 nanometers.

6. The electrophotographic imaging member of claim 1, wherein the electrophotographic imaging member exhibits greater spectral sensitivity and greater broadband sensitivity compared to an electrophotographic imaging member comprising a charge generation section consisting essentially of benzimidazole perylene.

7. The electrophotographic imaging member of claim 1, wherein the electrophotographic imaging member exhibits greater broadband and spectral sensitivity in the near infrared region compared to an electrophotographic imaging member comprising a charge generation section consisting essentially of benzimidazole perylene.

8. The electrophotographic imaging member of claim 1, wherein the electrophotographic imaging member exhibits equivalent or greater broadband and spectral sensitivity compared to an electrophotographic imaging member comprising a charge generation section consisting essentially of hydroxygallium phthalocyanine.

9. The electrophotographic imaging member of claim 1, further comprising a substrate adjacent to the benzimidazole perylene layer of the charge generation section.

10. The electrophotographic imaging member of claim 1, further comprising a substrate adjacent to the charge transport layer and to the hydroxygallium phthalocyanine layer of the charge generation section.

11. The electrophotographic imaging member of claim 10, further comprising an overcoating layer adjacent to the benzimidazole perylene layer of the charge generation section.

12. The electrophotographic imaging member of claim 1, further comprising aryl amine hole transport molecules in the charge generation section.

13. A method of manufacturing an electrophotographic imaging member comprising:

layering a first dispersion comprising benzimidazole perylene photoconductive pigment in polymer or copolymer binder upon a substrate to form a layer of benzimidazole perylene;

layering a second dispersion comprising hydroxygallium phthalocyanine in polymer or copolymer binder to form a layer of hydroxygallium phthalocyanine immediately adjacent to the layer of benzimidazole perylene; and applying a charge transport layer adjacent to the hydroxygallium phthalocyanine layer.

* * * * *